US011418868B2

(12) United States Patent
Lu

(10) Patent No.: US 11,418,868 B2
(45) Date of Patent: Aug. 16, 2022

(54) EARPHONE AND HEAD-MOUNTED EARPHONE

(71) Applicants: DEXIN ELECTRONIC LTD., Guangdong (CN); DEXIN CORPORATION, New Taipei (TW)

(72) Inventor: Ho-Lung Lu, New Taipei (TW)

(73) Assignees: DEXIN ELECTRONIC LTD., Guangdong (CN); DEXIN CORPORATION, New Taipei (TW)

( * ) Notice: Subject to any disclaimer, the term of this patent is extended or adjusted under 35 U.S.C. 154(b) by 0 days.

(21) Appl. No.: 16/989,897

(22) Filed: Aug. 11, 2020

(65) Prior Publication Data

US 2021/0306729 A1 Sep. 30, 2021

(30) Foreign Application Priority Data

Mar. 24, 2020 (TW) ..... 109109755

(51) Int. Cl.
*H04R 1/10* (2006.01)

(52) U.S. Cl.
CPC ..... *H04R 1/105* (2013.01); *H04R 1/1016* (2013.01); *H04R 1/1066* (2013.01); *H04R 1/1075* (2013.01)

(58) Field of Classification Search
CPC ..... H04R 1/105; H04R 1/1016; H04R 5/0335
See application file for complete search history.

(56) References Cited

U.S. PATENT DOCUMENTS 2,149,341 A * 3/1939 Harrison ..... H04R 1/1066 381/379
2,337,953 A * 12/1943 Wirsching ..... H04R 5/0335 381/378
3,356,797 A * 12/1967 Konzelmann ..... H04R 1/1066 379/430
4,138,598 A * 2/1979 Cech ..... H04R 1/08 379/430
4,542,803 A * 9/1985 Houng ..... H04R 1/1058 181/129
4,901,355 A * 2/1990 Moore ..... A61F 9/029 381/327
5,298,692 A * 3/1994 Ikeda ..... H04R 1/1016 181/135
5,327,178 A * 7/1994 McManigal ..... H04R 1/1066 351/158

(Continued)

FOREIGN PATENT DOCUMENTS

WO WO2013062454 A1 5/2013

*Primary Examiner* — Ryan Robinson
(74) *Attorney, Agent, or Firm* — Li & Cai Intellectual Property Office

(57) ABSTRACT

An earphone and a head-mounted earphone are provided. The head-mounted earphone includes a head-mounted accessory and a pair of earbud accessories. Each of the earbud accessories has a seat body, a speaker, and a connecting part. The speaker is affixed on a side of the seat body and the connecting part is disposed between the seat body and the speaker. The connecting part has a through hole, and two ends of the head-mounted accessory can be respectively disposed to be inserted into the through hole of each of the earbud accessories, such that the head-mounted accessory is detachably connected to the connecting part.

8 Claims, 8 Drawing Sheets

(56) References Cited

U.S. PATENT DOCUMENTS

| | | | | | |
|---|---|---|---|---|---|
| 5,715,323 | A * | 2/1998 | Walker | H04R 1/10 | 351/123 |
| 5,764,778 | A * | 6/1998 | Zurek | H04R 1/406 | 381/312 |
| 5,988,812 | A * | 11/1999 | Wingate | H04M 1/05 | 351/158 |
| 8,363,875 | B2 * | 1/2013 | Ito | H04R 1/1066 | 381/379 |
| 8,913,772 | B2 * | 12/2014 | Yamaguchi | H04R 1/1058 | 381/370 |
| 9,619,201 | B2 * | 4/2017 | Jannard | G06F 3/167 | |
| 2008/0019557 | A1 * | 1/2008 | Bevirt | H04R 1/083 | 381/386 |
| 2013/0058517 | A1 | 3/2013 | Lee et al. | | |
| 2015/0289047 | A1 * | 10/2015 | Greig | H04R 5/0335 | 381/74 |

* cited by examiner

EARPHONE AND HEAD-MOUNTED EARPHONE

CROSS-REFERENCE TO RELATED PATENT APPLICATION

This application claims the benefit of priority to Taiwan Patent Application No. 109109755, filed on Mar. 24, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an earphone, and more particularly to a head-mounted earphone that cooperates with a head-mounted accessory.

BACKGROUND OF THE DISCLOSURE

Headphones that cover the ears of users are usually not suitable for outdoor activities, since helmets, ski goggles, and ear protectors may hinder the usage of these headphones. However, conventional earbuds are unable to fit the ear shapes of all users, making the earbuds unable to be worn for a long period of time since they can easily fall off, especially when exercising.

The US patent application No. 2013/0058517 discloses an earphone that is attached to an in-ear hook, and the in-ear hook can be attached to the earphone in a variety of manners. This patent application focuses on the connection between the in-ear hook and the earphone, but does not truly provide a solution that resolves problems that may arise when attempting to fit different ear shapes with one type of earbud.

The PCT patent application No. 2013/062454 discloses a headphone that is disassembled into ear-cups and a head support member, which allows the headphone units to be supported and fixed on a different area of the head in various manners, and be used in different occasions. However, the size of the headphones in this patent application is relatively large, and a magnetic attraction between the ear-cups and the head support member (e.g., component 2, 17, and 18 as shown in FIG. 2 of this patent application) is still not enough to form a sturdy earbud.

SUMMARY OF THE DISCLOSURE

In response to the above-referenced technical inadequacies, the present disclosure provides a head-mounted earphone.

In one aspect, the present disclosure provides a head-mounted earphone including a head-mounted accessory and a pair of earbud accessories. Each of the earbud accessories includes a seat body, a speaker, and a connecting part. The speaker is disposed on a side of the seat body, and the connecting part is disposed between the seat body and the speaker. The connecting part has a through hole, and two ends of the head-mounted accessory can be respectively disposed to be inserted into the through hole of each of the earbud accessories, such that the head-mounted accessory is detachably connected to the connecting part.

In another aspect, the present disclosure provides an earphone, which cooperates with a head-mounted accessory, including a pair of earbud accessories. Each of the earbud accessories includes a seat body, a speaker, and a connecting part. The speaker is disposed on a side of the seat body, and the connecting part is disposed between the seat body and the speaker. The connecting part has a through hole, and two ends of the head-mounted accessory can be respectively disposed to be inserted into the through hole of each of the earbud accessories, such that the head-mounted accessory is detachably connected to the connecting part.

The present disclosure provides earbud accessories that are attached to a head-mounted accessory, so as to form a head-mounted earphone. The earbud accessories can also be detached from the assembly of the head-mounted earphone, and used individually as conventional earbuds. The earbud accessories that cooperate with the head-mounted accessory can be worn when exercising, so as to prevent the earphone from falling off from the head of a user, and also increase the aesthetics of the appearance.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
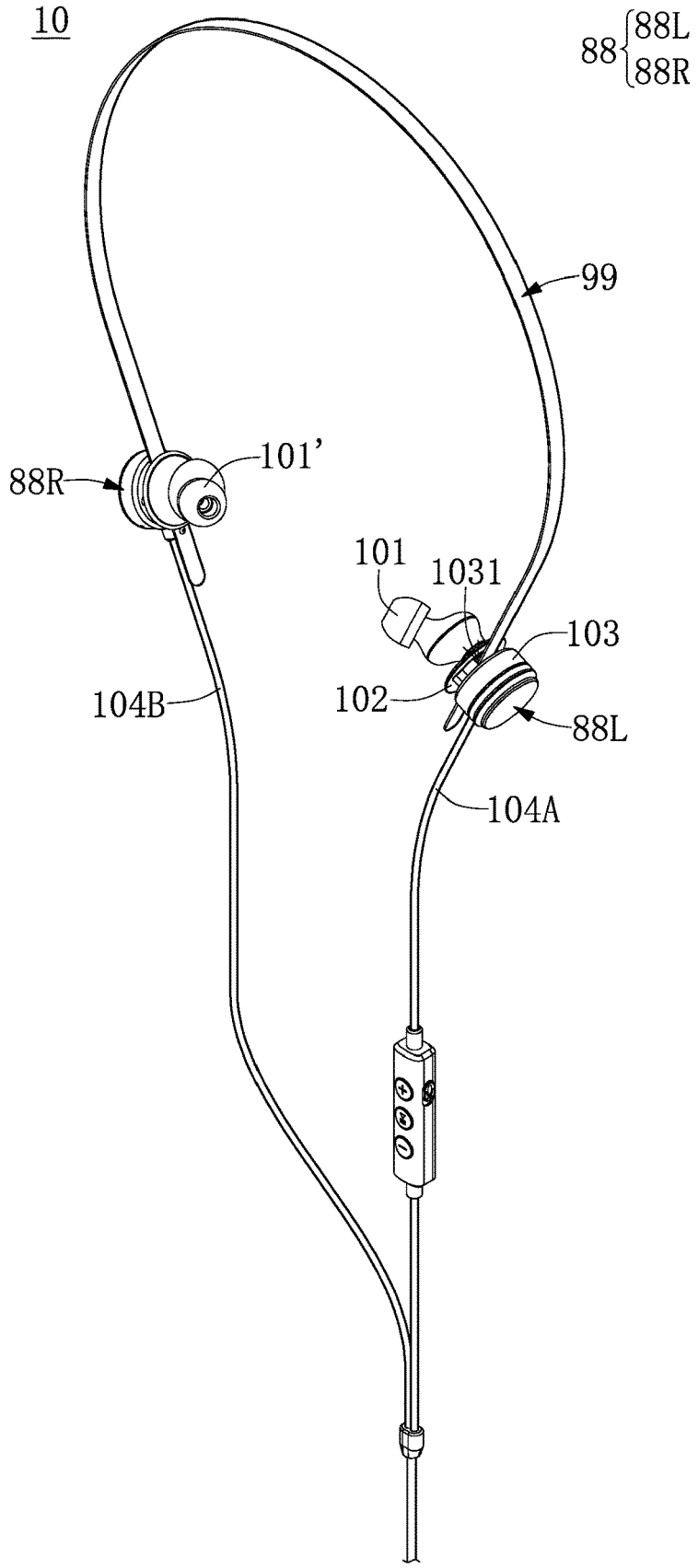
FIG. 1 is a schematic view of a head-mounted earphone in one embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1, a schematic view of a head-mounted earphone in one embodiment of the present disclosure is provided. As shown in FIG. 1, a head-mounted earphone 10 includes a head-mounted accessory 99 and a pair of earbud accessories 88. Each of the earbud accessories 88L and 88R includes a seat body 103, a speaker 101, and a connecting part 102.

In one embodiment, the head-mounted earphone 10 is positioned inside an ear of a user (not shown in the figures), the speaker 101 is connected to the seat body 103 through at least one affixing unit (not shown in the figures), and a through hole 1031 of the connecting part 102 is used to accommodate the head-mounted accessory 99. A first cable 104A is extended from the speaker 101, and an end of the first cable 104A is connected to an end of a second cable 104B extended from a speaker 101'.

Figure 2A:
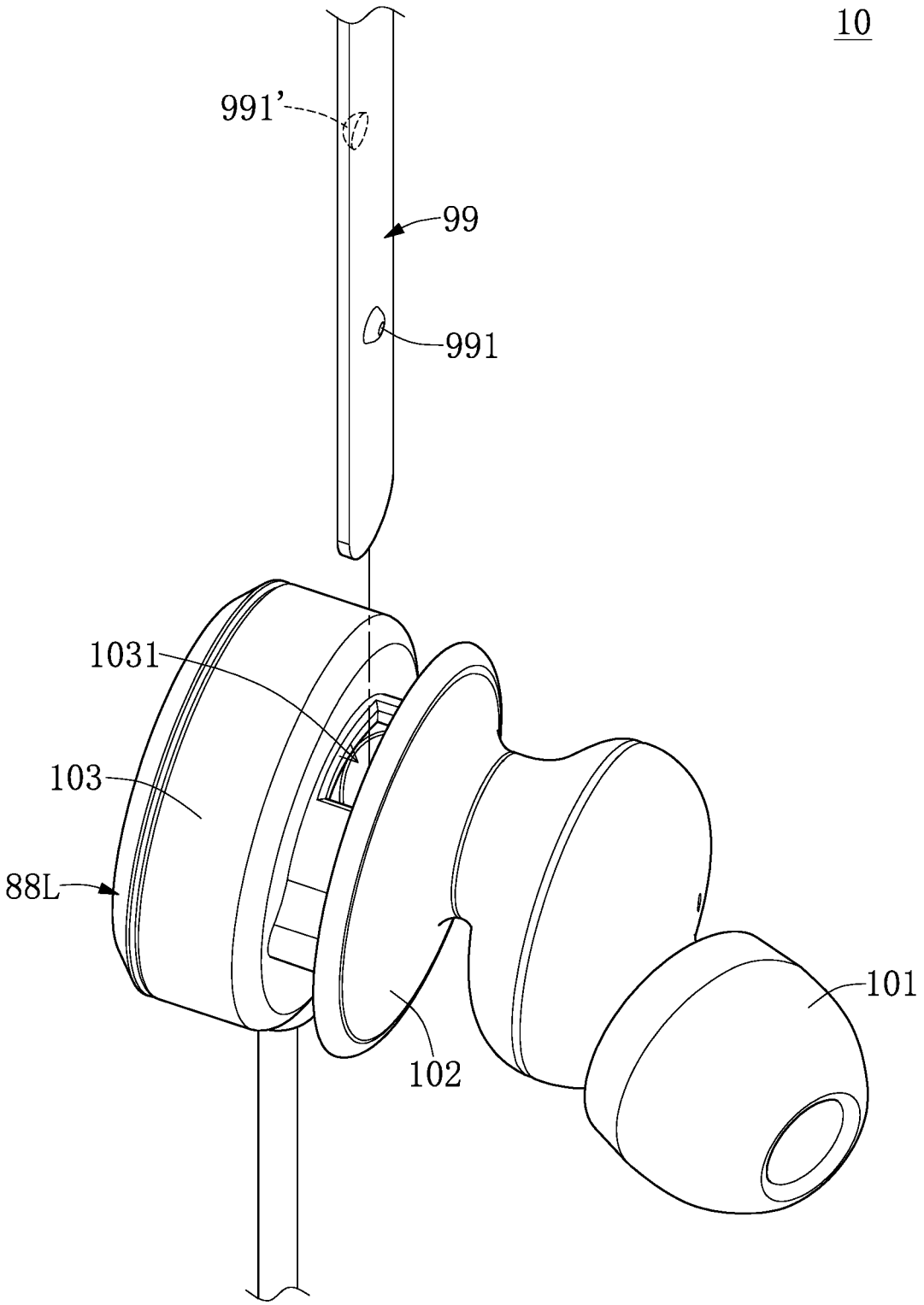
FIG. 2A is a schematic view of one of the earbud accessories being separated from a head-mounted accessory in one embodiment of the present disclosure.
Figure 2B:
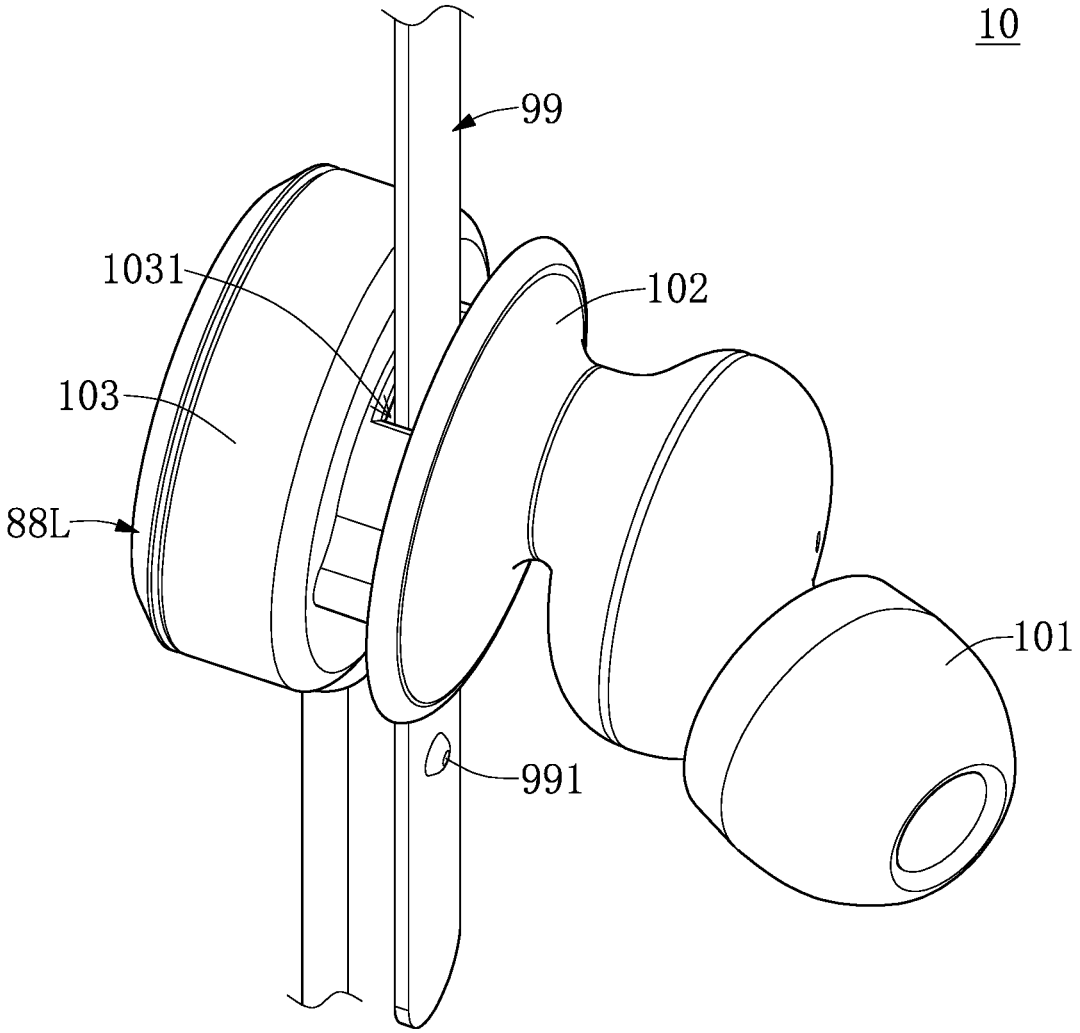
FIG. 2B is a schematic view of one of the earbud accessories being attached to the head-mounted accessory in one embodiment of the present disclosure.
Figure 2C:
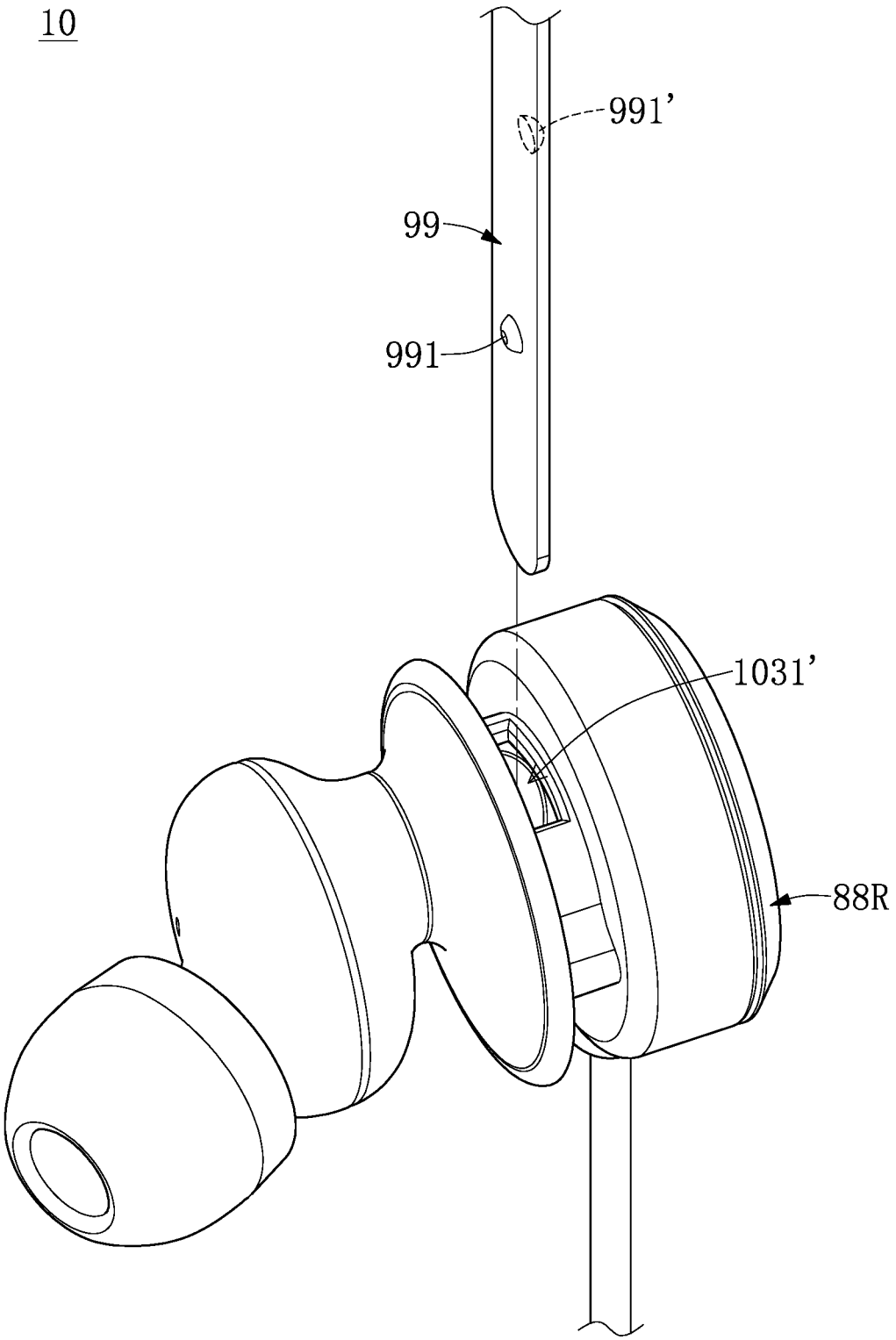
FIG. 2C is a schematic view of another one of the earbud accessories being separated from the head-mounted accessory in one embodiment of the present disclosure.

Reference is made to FIG. 2A to FIG. 2C, and in conjunction with FIG. 1. FIG. 2A is a schematic view of one of the earbud accessories and the head-mounted accessory before being assembled to each other in one embodiment of the present disclosure, and the earbud and the head-mounted accessory are in a separate state in this embodiment. As shown in the figure, the head-mounted earphone 10 includes the head-mounted accessory 99 and the pair of earbud accessories 88. However, in order to present a better view of a partial structure of the pair of earbud accessories 88 and the head-mounted accessory 99 that are engaged with each other, the head-mounted accessory 99 shown in FIG. 2A to FIG. 2C is merely an end of the complete head-mounted accessory 99 shown in FIG. 1. That is to say, the head-mounted accessory 99 shown in FIG. 2A to FIG. 2C is merely a schematic view of the complete structure.

As shown in FIG. 2A, the earbud accessory 88L includes the seat body 103, the speaker 101, and the connecting part 102. However, it is worth noting that FIG. 2A only shows one of the pair of earbud accessories 88, and the earbud accessory 88R on the opposite side of the earbud accessory 88L also has components of the seat body 103, the speaker 101, and the connecting part 102. In one embodiment, the speaker 101 is affixed on a side of the seat body 103 and the connecting part 102 is disposed between the seat body 103 and the speaker 101. The connecting part 102 has the through hole 1031, and two ends of the head-mounted accessory 99 can be respectively disposed to be inserted into the through hole 1031 of each of the pair of earbud accessories 88, such that the head-mounted accessory 99 is detachably connected to the connecting part 102.

In one embodiment, the head-mounted accessory 99 can be a flexible head-mounted accessory, and the material of the head-mounted accessory 99 can be rigid materials or plastic materials, but the present disclosure is not limited thereto.

In one embodiment, each of a first surface on the side of the speaker 101 and a second surface on the side of the seat body 103 of an end of the head-mounted accessory 99 has at least one anti-slip bump 991 and 991'.

In one embodiment, the first surface on the side of the speaker 101 has a plurality of anti-slip bumps, which can be disposed on different positions on the end of the head-mounted accessory 99. The size of the head-mounted accessory 99 can be suitable for users with different sizes and shapes of heads through changing the corresponding position where the through hole 1031 and the head-mounted accessory 99 are engaged with each other, and the present disclosure is not limited thereto.

In other embodiments, one of the first surface and the second surface of the end of the head-mounted accessory 99 has at least one anti-slip bump, but the present disclosure is not limited thereto.

In one embodiment, the at least one anti-slip bump 991 of the first surface of the head-mounted accessory 99 can be engaged with a side of the through hole 1031.

In one embodiment, when the head-mounted accessory 99 is under a pulling force that is not greater than a threshold force and that is directed toward the through hole 1031, the through hole 1031 and the head-mounted accessory 99 remain engaged. Through changing the abovementioned pulling force, the corresponding positions of the through hole 1031 and the head-mounted accessory 99 can be changed while the length of the head-mounted accessory 99 remains the same. When the pulling force is greater than the abovementioned threshold force, the through hole 1031 is detached from the at least one anti-slip bump 991.

FIG. 2B is a schematic view of one of the earbud accessories being attached to the head-mounted accessory in one embodiment of the present disclosure. In this embodiment, the earbud accessory 88L and the head-mounted accessory 99 are attached to each other.

As shown in FIG. 2B, the head-mounted earphone 10 includes the head-mounted accessory 99 and the pair of earbud accessories 88. The earbud accessory 88L includes the seat body 103, the speaker 101, and the connecting part 102.

More particularly, the earbud accessory 88L is positioned inside an ear of the user (not shown in the figures), the speaker 101 is connected to the seat body 103, and the through hole 1031 of the connecting part 102 is used to accommodate the head-mounted accessory 99. The head-mounted accessory 99 can be engaged with the through hole 1031 through the connecting part 102.

In one embodiment, when the head-mounted accessory 99 is under a pulling force that is not greater than a threshold force and that is toward the through hole 1031, the through hole 1031 and the head-mounted accessory 99 remains engaged. Through changing the abovementioned pulling force, the corresponding positions of the through hole 1031 and the head-mounted accessory 99 can be changed while the length of the head-mounted accessory 99 remains the same.

In one embodiment, when the head-mounted accessory 99 is under a pulling force that is greater than a threshold force and that is directed in a direction away from the through hole 1031, the through hole 1031 and the at least one anti-slip bump 991 are detached from each other, and the head-mounted accessory 99 is not engaged with the through hole 1031.

FIG. 2C is a schematic view of another one of the earbud accessories and the head-mounted accessory before being assembled to each other in one embodiment of the present disclosure. In this embodiment, the earbud accessory 88R and the head-mounted accessory 99 are detached from each other. Compared with the earbud accessory 88L of the head-mounted earphone 10 as shown in FIG. 2A, FIG. 2C shows the earbud accessory 88R on another side of the head-mounted earphone 10. The size of the head-mounted accessory 99 can be suitable for users with different sizes and shapes of heads through changing the corresponding position where the through hole 1031 and the head-mounted accessory 99 are engaged with each other.

Figure 3A:
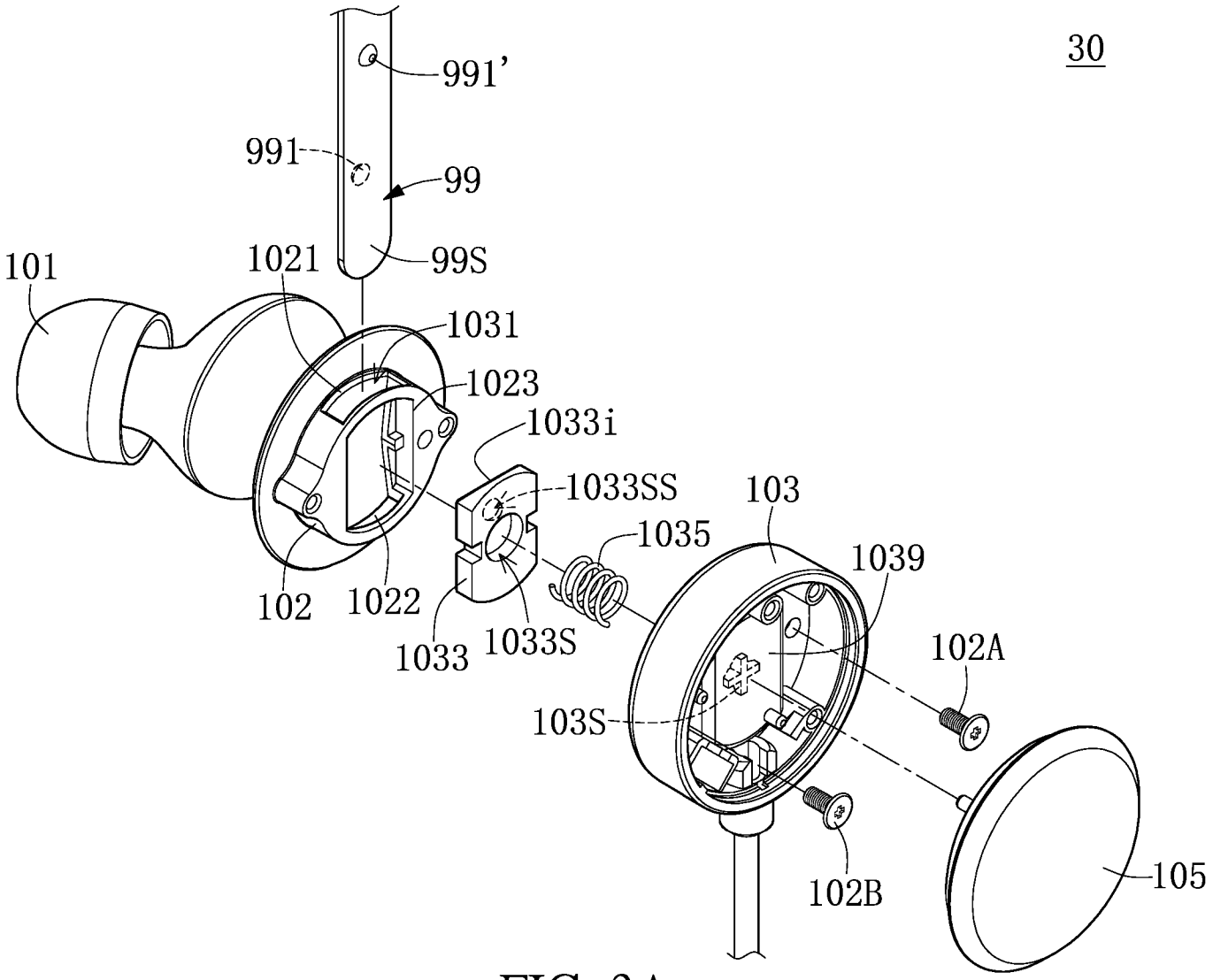
FIG. 3A is an exploded partial view showing the earbud facing inward of an ear, and the earbud accessories and the head-mounted accessory being assembled to each other in one embodiment of the present disclosure.

Reference is made to FIG. 2A, FIG. 2B, FIG. 2C, and FIG. 3A. FIG. 3A is a schematic view, facing inward of an ear, that portrays the details of the state of the earbud accessories and the head-mounted accessory being assembled to each other in one embodiment of the present disclosure.

A head-mounted earphone 30 is positioned inside an ear of a user (not shown in the figures). The head-mounted earphone 30 includes the head-mounted accessory 99 and a pair of earbud accessories. Each of the pair of earbud accessories includes the seat body 103, the connecting part 102, and the speaker 101.

The seat body 103 of the head-mounted earphone 30 is disposed between the connecting part 102 and a casing 105.

The geometric structure of the casing 105 complements that of the seat body 103, and the casing 105 is engaged with an end of the seat body 103. In alternate implementations, the casing 105 can be engaged with the seat body 103 with binding agents, rivets, calipers, and other related technologies, and the present disclosure is not limited thereto.

The casing 105 is substantially rounded. In other examples, the casing 105 can be of other geometric shapes, e.g., oval, rectangular, or heart-shaped, and the present disclosure is not limited thereto.

The seat body 103 is connected to the connecting part 102 and the speaker 101 through the affixing units 102A and 102B. The seat body 103 has a rectangular part 1039, and the rectangular part 1039 has a star-shaped protrusion 103S, which is used to form a tight structure with a spring element 1035 and a liner 1033.

The connecting part 102 is disposed between the seat body 103 and the speaker 101. The connecting part 102 has a first side surface 1021, a second side surface 1022, and a third side surface 1023. The first side surface 1021 is located at the upper part of the connecting part 102, the second side surface 1022 is located at the lower part of the connecting part 102, and the third side surface 1023 is located on a side of the connecting part 102 near the seat body 103.

The first side surface 1021, the second side surface 1022, and the third side surface 1023 of the connecting part 102 are hollowed-out to form the through hole 1031.

Through the hollowed-out structure inside the connecting part 102, the connecting part 102 is able to include at least one of a spring, a slot, and a hook structure, such that the head-mounted accessory 99 and the through hole 1031 can be engaged with each other.

The through hole 1031 is used to accommodate the head-mounted accessory 99, and the head-mounted accessory 99 can be engaged with the through hole 1031 through the liner 1033 and the spring element 1035. In one embodiment, the connecting part 102 can include the spring element 1035 and the liner 1033.

Two sides of the liner 1033 respectively includes an aperture 1033S and a guiding inclined surface 1033*i*. The aperture 1033S is disposed on the side toward the seat body 103 and close to the center of the liner 1033. The guiding inclined surface 1033*i* is disposed on the side toward the connecting part 102 and close to the upper part of the liner 1033.

The liner 1033 is disposed on a side of the through hole 1031. In the embodiment shown in FIG. 3A, the liner 1033 can be disposed in the hollowed-out through hole 1031 of the third side surface 1023 of the connecting part 102.

Two sides of the spring element 1035 are respectively disposed between the aperture 1033S on a side of the liner 1033 and the star-shaped protrusion 103S of the rectangular part 1039 of the seat body 103. That is to say, the end of the spring element 1035 facing inward of an ear is disposed at the aperture 1033S on a side of the liner 1033, and the end of the spring element 1035 facing outward of an ear is disposed at the star-shaped protrusion 103S of the rectangular part 1039 of the seat body 103, thus making the spring element 1035 and the liner 1033 to form a more tightly engaged structure.

In one embodiment, when the head-mounted accessory 99 is not yet inserted toward and through the through hole 1031, the head-mounted accessory 99 and the through hole 1031 are in a state of separation, the spring element 1035 and the liner 1033 can be disposed in the hollowed-out through hole 1031 of the third side surface 1023 of the connecting part 102, by virtue of an elastic force of the spring element 1035 toward a collinear direction of the liner 1033 and the speaker 101.

In one embodiment, when the head-mounted accessory 99 is inserted toward and through the through hole 1031, by virtue of the elastic force of the spring element 1035 toward a collinear direction of the liner 1033 and the speaker 101, a first surface 99S of the head-mounted accessory 99 on the side of the speaker 101 is engaged with the guiding inclined surface 1033*i* of the liner 1033 on the side of the through hole 1031, such that the first surface 99S of the head-mounted accessory 99 and a side of the liner 1033 forms an engaging surface.

Since the guiding inclined surface 1033*i* has a wedge-shaped structure that is narrow at the upper part and wider at the lower part, when the head-mounted accessory 99 is inserted toward and through the through hole 1031, an end of the head-mounted accessory 99 can be smoothly inserted into a side of the liner 1033 using the wedge structure of the guiding inclined surface 1033*i*, so that the side of the liner 1033 and the first surface 99S of the head-mounted accessory 99 form an engaging surface.

In one embodiment, when the head-mounted accessory 99 is under a pulling force toward the through hole 1031 that is not greater than a threshold force, the through hole 1031 and the head-mounted accessory 99 remain engaged. Through changing the abovementioned pulling force, the corresponding positions of the through hole 1031 and the head-mounted accessory 99 can be changed while the length of the head-mounted accessory 99 remains the same. In an example, when the pulling force is greater than the abovementioned threshold force, the through hole 1031 is detached from the at least one anti-slip bump 991.

In one embodiment, when the head-mounted accessory 99 and the through hole 1031 are engaged with each other, the head-mounted accessory 99 is under a pulling force as if being pulled out of the through hole 1031, an elastic force of the spring element 1035 toward a collinear direction of the liner 1033 and the speaker 101 produces a friction against the attaching surface. When the friction is less than the pulling force, the first surface 99S of the head-mounted accessory 99 is no longer engaged with the guiding inclined surface 1033*i* of the liner 1033 on the side of the through hole 1031.

Figure 3B:
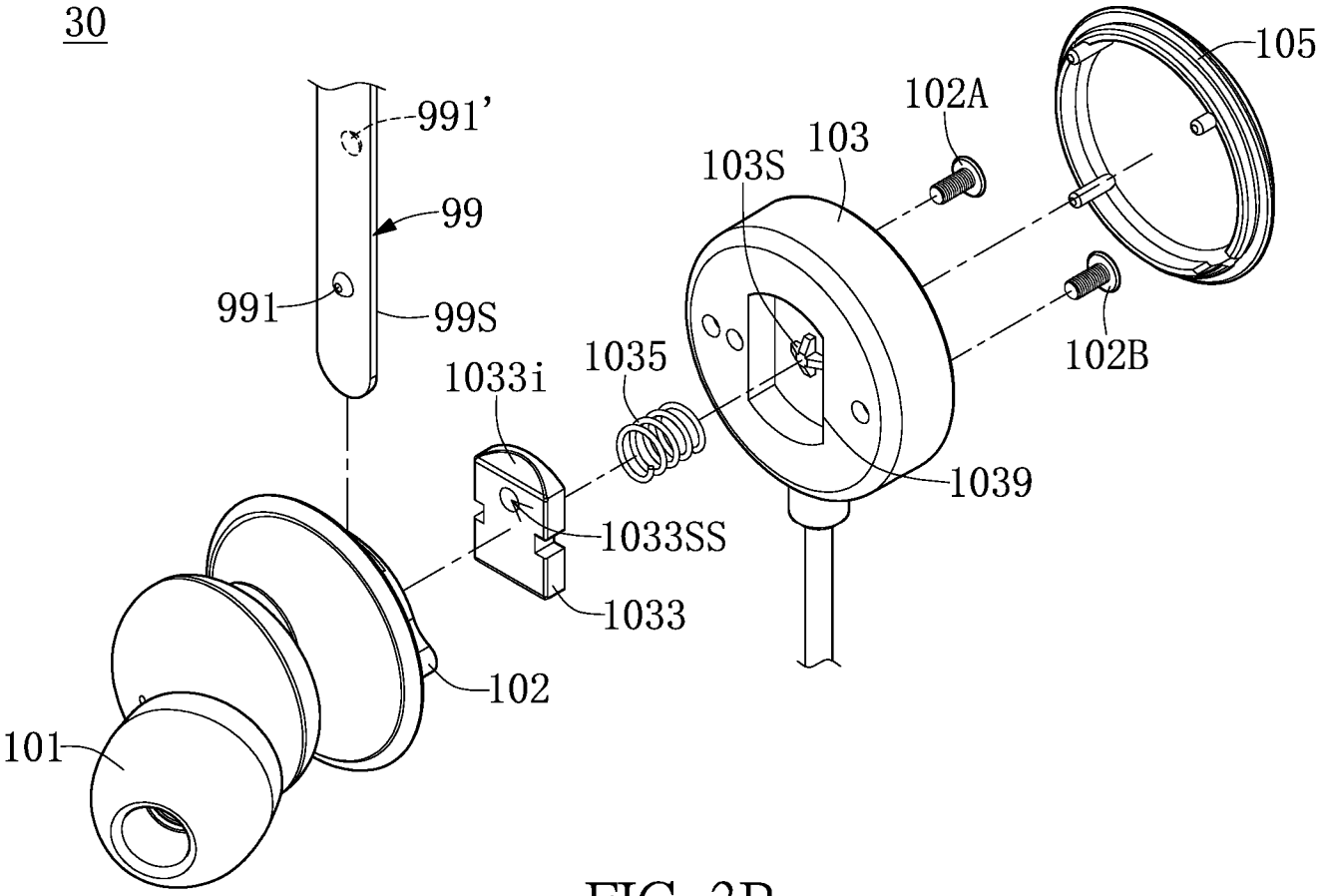
FIG. 3B is an exploded partial view showing the earbud facing outward of an ear, and the earbud accessories and the head-mounted accessory being assembled to each other in one embodiment of the present disclosure.

FIG. 3B is an exploded partial view showing the earbud facing outward of an ear, and the earbud accessories and the head-mounted accessory being assembled to each other in one embodiment of the present disclosure.

The rectangular part 1039 of the seat body 103 has the star-shaped protrusion 103S that forms a caliper with the spring element 1035 and the liner 1033, such that the spring element 1035 and the liner 1033 form a tightly engaged structure.

Two sides of the spring element 1035 are respectively disposed between the aperture 1033S on a side of the liner 1033 and the star-shaped protrusion 103S of the rectangular part 1039 of the seat body 103.

In one embodiment, when the head-mounted accessory 99 is not yet inserted toward and through the through hole 1031, the head-mounted accessory 99 and the through hole 1031 are in a state of separation, the spring element 1035 and the liner 1033 can be disposed in the rectangular part 1039 of the seat body 103. By virtue of an elastic force of the spring element 1035 toward a collinear direction of the liner 1033 and the speaker 101, the spring element 1035 and the liner 1033 can be disposed in the through hole 1031 that is hollowed-out on the third side surface 1023 of the connecting part 102.

In one embodiment, when the head-mounted accessory 99 is inserted toward and through the through hole 1031 downwardly, by virtue of the elastic force of the spring element 1035 toward a collinear direction of the liner 1033 and the speaker 101, the first surface 99S of the head-mounted accessory 99 on the side of the speaker 101 is engaged with the guiding inclined surface 1033*i* of the liner 1033 on the side of the through hole 1031.

In one embodiment, the side opposite to the aperture 1033S of the liner 1033 further includes a recess 1033SS, which is used to engage with the at least one anti-slip bump 991' of the second surface of the head-mounted accessory 99.

By virtue of the friction produced against the engaging surface by the elastic force of the spring element 1035 toward a collinear direction of the liner 1033 and the speaker 101, and the engaging force between the at least one anti-slip bump 991' and the recess 1033SS, the head-mounted accessory 99 and the through hole 1031 can be more tightly engaged with each other, so as to prevent the earphone from falling off from the head of the user.

Figure 4:
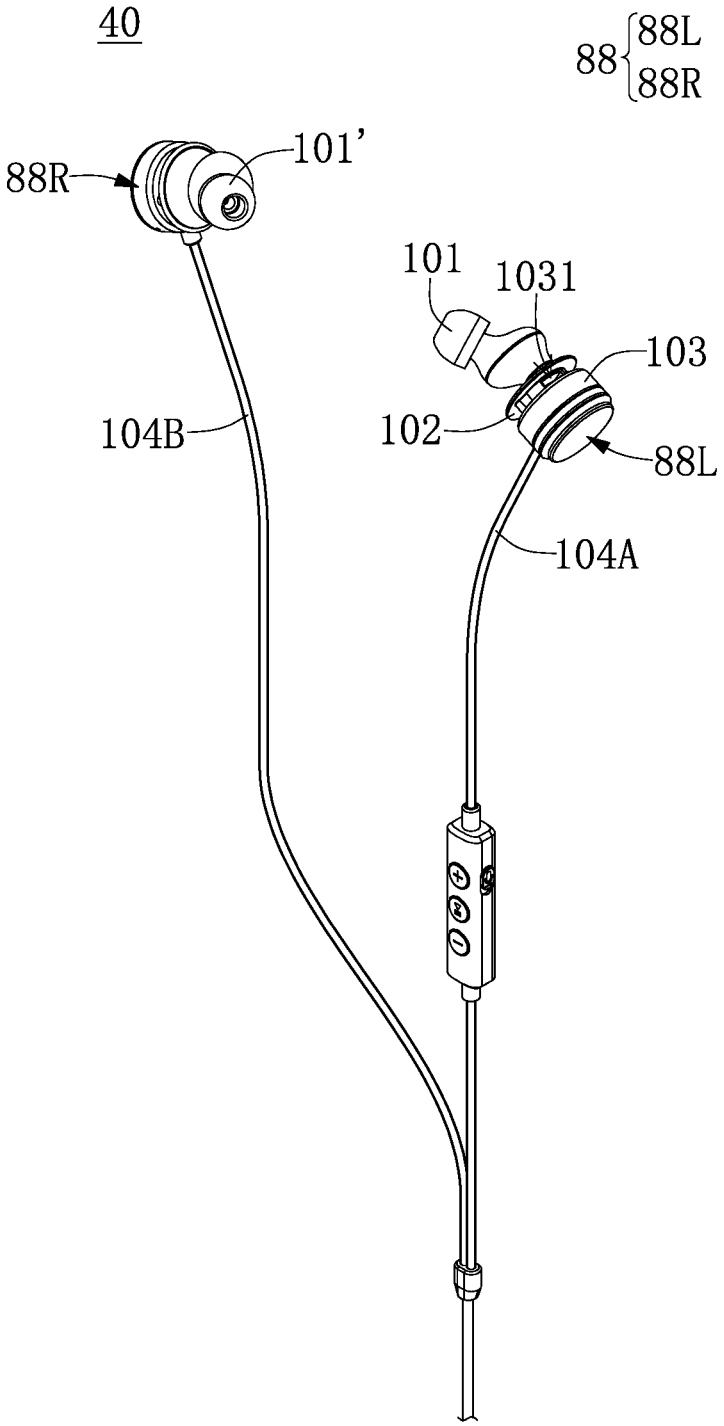
FIG. 4 is a schematic view of the earbud accessories in one embodiment of the present disclosure.

Reference is made to FIG. 1, FIG. 3A, and FIG. 4. FIG. 4 is a schematic view of the earbud accessories in one embodiment of the present disclosure. An earphone can be disposed to cooperate with a flexible head-mounted accessory for use. An earphone 40 includes a pair of earbud accessories 88. Each of the earbud accessories 88L, 88R includes a seat body, a speaker, and a connecting part.

In one embodiment, the earbud accessory 88L includes the seat body 103, the speaker 101, and the connecting part 102. The first cable 104A is extended from the speaker 101. An end of the first cable 104A is connected to an end of second cable 104B extended from another speaker 101'.

More particularly, the speaker 101 is affixed at a side of the seat body 103, and the connecting part 102 is disposed between the seat body 103 and the speaker 101. The connecting part 102 has the through hole 1031, and two ends of the flexible head-mounted accessory can be respectively disposed to be inserted into the through hole 1031 of each of the pair of earbud accessories 88, such that the flexible head-mounted accessory is detachably connected to the connecting part 102.

In one embodiment, the abovementioned connecting part 102 includes one of a slot and a hook structure, such that the flexible head-mounted accessory and the through hole 1031 can be engaged with each other.

In one embodiment, a surface of an end of the flexible head-mounted accessory has at least one anti-slip bump.

Figure 5:
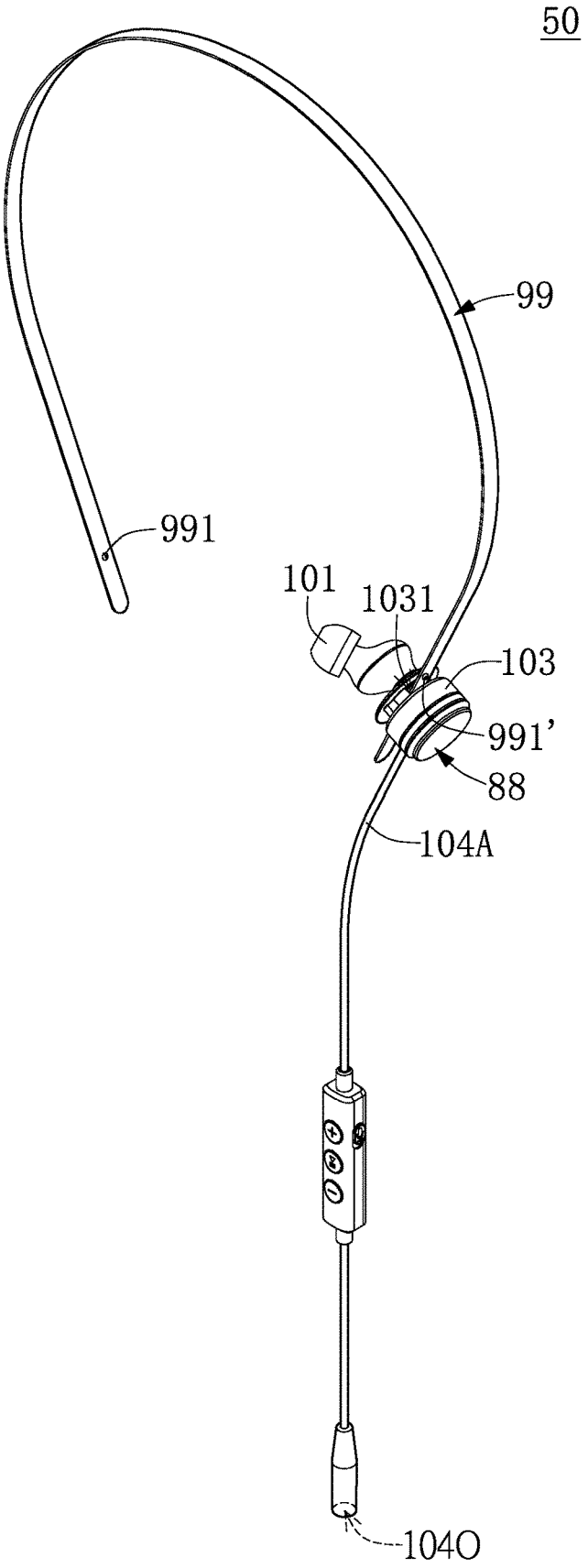
FIG. 5 is a schematic view of a one-sided earbud accessory in one embodiment of the present disclosure.

FIG. 5 is a schematic view of a one-sided earbud in one embodiment of the present disclosure. An earphone 50 is positioned inside an ear of a user (not shown in the figures). As shown in FIG. 5, an earbud accessory 88 can be disposed to cooperate with the head-mounted accessory 99 for use. The speaker 101 can be connected to the seat body 103 by at least one affixing unit (not shown in the figures), the through hole 1031 is used to accommodate the head-mounted accessory 99, and the head-mounted accessory 99 can be engaged with the through hole 1031 through a connecting part.

In one embodiment, the head-mounted accessory 99 has the anti-slip bumps 991 and 991'.

Generally speaking, the first cable and the second cable can include a male connector of a conventional audio source plug. The male connector can be in any size, including ⅛ inches and ¼ inches. The first cable and the second cable can be connected with a Cellular Telecommunications and Internet Association (CTIA) port and an Open Mobile Terminal Platform (OMTP) port.

In alternate implementations, the male connector can also include other electrical connecting interfaces, e.g., Universal Serial Bus (USB), i-Link, and other plug connectors.

The earphone 50 can also cascade with other electronic devices through terminals such as a Type-C port, also referred to as USB Type-C or simply USB-C, which is a USB hardware interface, and the biggest feature of the appearance of the USB Type-C is that an upper and a lower part thereof are in exact symmetry, such that the front and back sides of the USB need no longer be distinguished from each other. Most of Android mobile devices, notebook computers, desktop computers, game consoles, and other electronic devices support the USB Type-C port. Moreover, a clicking sound is produced after the plug connector of the Type-C port is successfully plugged into the socket connector, and the Type-C ports are able to charge the electronic devices through the USB Power Delivery technology.

As shown in FIG. 5, the speaker 101 can be operably connected to the first cable 104A, and the first cable 104A includes a socket connector 1040, which is used to connect a USB Type-C port (not shown in the figures) of a mobile device, and the speaker 101 can receive electricity through the connection of the socket connector 1040 and a plug connector (not shown in the figures) of the USB Type-C port.

In conclusion, the present disclosure provides an earbud that is attached to a head-mounted accessory, so as to form a head-mounted earphone. The earbud accessories can also be detached from the assembled head-mounted earphone, and used individually as conventional earbuds. The manner of attachment of the earbud accessories and the head-mounted accessory can be realized through mechanical designs using slots or hooks. The earbud accessories that cooperate with the head-mounted accessory of the present disclosure can be worn when exercising, so as to prevent the earphone from falling off from the head of the user, and also increase the aesthetics of the appearance.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A head-mounted earphone, comprising:

a head-mounted accessory, wherein the head-mounted accessory is a flexible head-mounted accessory; and a pair of earbud accessories, wherein each of the earbud accessories includes a seat body, a speaker, and a connecting part;

wherein the speaker is disposed on a side of the seat body, the connecting part is disposed between the seat body and the speaker, the connecting part has a through hole, and two ends of the head-mounted accessory can be respectively disposed to be inserted into the through hole of each of the earbud accessories, such that the head-mounted accessory is detachably connected to the connecting part;

wherein the connecting part includes a spring element and a liner, the liner includes an aperture and a guiding inclined surface, the liner is disposed on a side of the through hole, and the spring element is disposed between the aperture of the liner and a star-shaped protrusion of the seat body.

2. The head-mounted earphone according to claim 1, wherein each of a first surface on the side of the speaker and a second surface on the side of the seat body of an end of the head-mounted accessory has at least one anti-slip bump.

3. The head-mounted earphone according to claim 1, wherein the connecting part includes at least one of a slot and a hook, such that the flexible head-mounted accessory is engaged with the through hole.

4. The head-mounted earphone according to claim 2, wherein the at least one anti-slip bump of the first surface of the head-mounted accessory is used to engage with an end of the through hole.

5. The head-mounted earphone according to claim 1, wherein a side of the aperture of the liner further includes a recess that is used to engage with the at least an anti-slip bump of the second surface of the head-mounted accessory.

6. The head-mounted earphone according to claim 1, wherein, through an elastic force of the spring element directing toward a collinear direction of the liner and the speaker, the first surface of the head-mounted accessory engages with the guiding inclined surface of the liner at the side of the through hole.

7. An earphone disposed to cooperate with a flexible head-mounted accessory, comprising:

a pair of earbud accessories, wherein each of the earbud accessories includes a seat body, a speaker, and a connecting part;

wherein the speaker is disposed on a side of the seat body, the connecting part is disposed between the seat body and the speaker, the connecting part has a through hole, and two ends of the flexible head-mounted accessory can be respectively disposed to be inserted into the through hole of each of the earbud accessories, such that the head-mounted accessory is detachably connected to the connecting part;

wherein the connecting part includes a spring element and a liner, the liner includes an aperture and a guiding inclined surface, the liner is disposed on a side of the through hole, and the spring element is disposed between the aperture of the liner and a star-shaped protrusion of the seat body.

8. The earphone according to claim 7, wherein a surface of an end of the flexible head-mounted accessory has at least one anti-slip bump.

* * * * *